US008091814B2

(12) United States Patent
Su

(10) Patent No.: US 8,091,814 B2
(45) Date of Patent: Jan. 10, 2012

(54) SINGLE-MOTOR SHREDDER

(76) Inventor: Chao-Lung Su, Taipei (TW)

( * ) Notice: Subject to any disclaimer, the term of this patent is extended or adjusted under 35 U.S.C. 154(b) by 152 days.

(21) Appl. No.: 12/710,719

(22) Filed: Feb. 23, 2010

(65) Prior Publication Data

US 2011/0204168 A1 Aug. 25, 2011

(51) Int. Cl.
*B02B 7/02* (2006.01)
*B02C 23/00* (2006.01)

(52) U.S. Cl. ..... 241/100; 241/236; 241/224

(58) Field of Classification Search ..... 241/100, 241/236, 224, 225
See application file for complete search history.

(56) References Cited

U.S. PATENT DOCUMENTS 4,232,860 A * 11/1980 Brown ..... 271/119
4,893,759 A * 1/1990 Mizobata ..... 241/100
5,975,445 A * 11/1999 Ko ..... 241/34
7,823,873 B1 * 11/2010 Su ..... 271/149
7,926,753 B2 * 4/2011 Carver ..... 241/99

* cited by examiner

*Primary Examiner* — Bena Miller
(74) *Attorney, Agent, or Firm* — patenttm.us

(57) ABSTRACT

A single-motor shredder has a housing, and multiple cutting rollers, a paper feeding mechanism and a motor mounted in the housing. A first gear set connects the cutting rollers with the motor and a second gear set connects the cutting rollers with the paper feeding mechanism. Only one motor is needed to drive the cutting rollers and the paper feeding mechanism. Therefore, the shredder is light and a manufacturing costs of the shredder are lowered. Moreover, the paper feeding mechanism separates a stack of paper into small piles to sequentially feed the stack of paper in small piles. Thus, the stack of paper does not jam the cutting rollersso improving lifetime of the shredder.

10 Claims, 10 Drawing Sheets

SINGLE-MOTOR SHREDDER

BACKGROUND OF THE INVENTION

1. Field of the Invention

The present invention relates to a shredder, especially to a shredder driven by a single motor.

2. Description of the Prior Art(s)

A shredder shreds sheets, such as, documents or files into small pieces to render information thereon unreadable.

A conventional shredder has two motors respectively driving a paper feeding mechanism and a cutting mechanism. A stack of paper is placed in the paper feeding mechanism, which may be a roller or a paging mechanism to separate the stack of paper into small piles and feed the piles of paper into the cutting mechanism.

However, the conventional shredder with two motors is heavy and manufacturing costs of the conventional shredder are high. Moreover, since the stack of paper is substantially upright, when one paper slides, other papers slide simultaneously so jamming the cutting mechanism.

To overcome the shortcomings, the present invention provides a single-motor shredder to mitigate or obviate the aforementioned problems.

SUMMARY OF THE INVENTION

The main objective of the present invention is to provide a single-motor shredder. The single-motor shredder has a housing, and multiple cutting rollers, a paper feeding mechanism and a motor mounted in the housing. A first gear set connects the cutting rollers with the motor and a second gear set connects the cutting rollers with the paper feeding mechanism.

Only one motor is needed to drive the cutting rollers and the paper feeding mechanism. Therefore, the shredder is light and manufacturing costs are lowered. Moreover, the paper feeding mechanism separates a stack of paper into small piles to sequentially feed the stack of paper in small piles. Thus, the stack of paper does not jam the cutting rollers so improving lifetime of the shredder.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
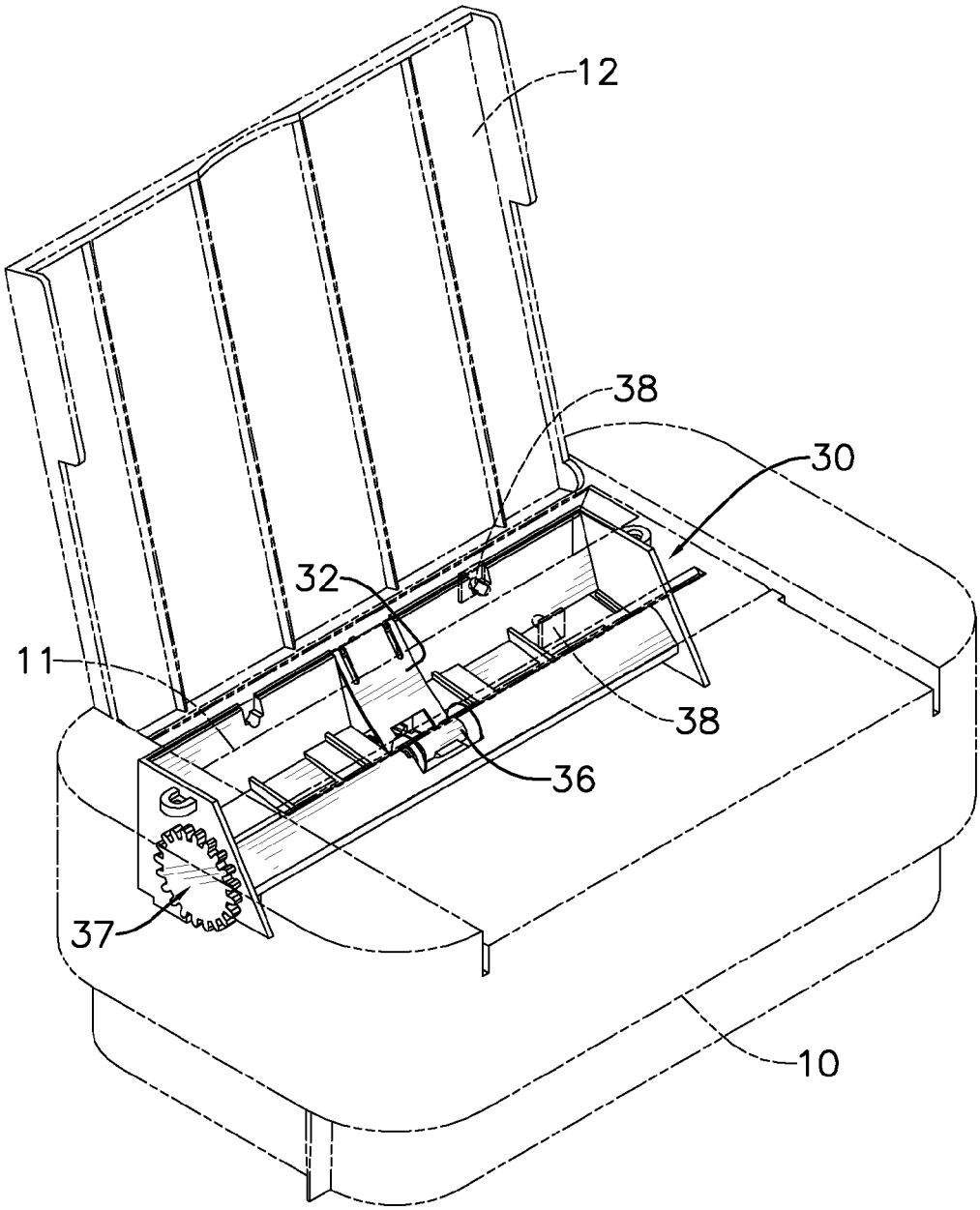
FIG. 1 is a perspective view of a single-motor shredder in accordance with the present invention, a housing shown in phantom lines.
Figure 5:
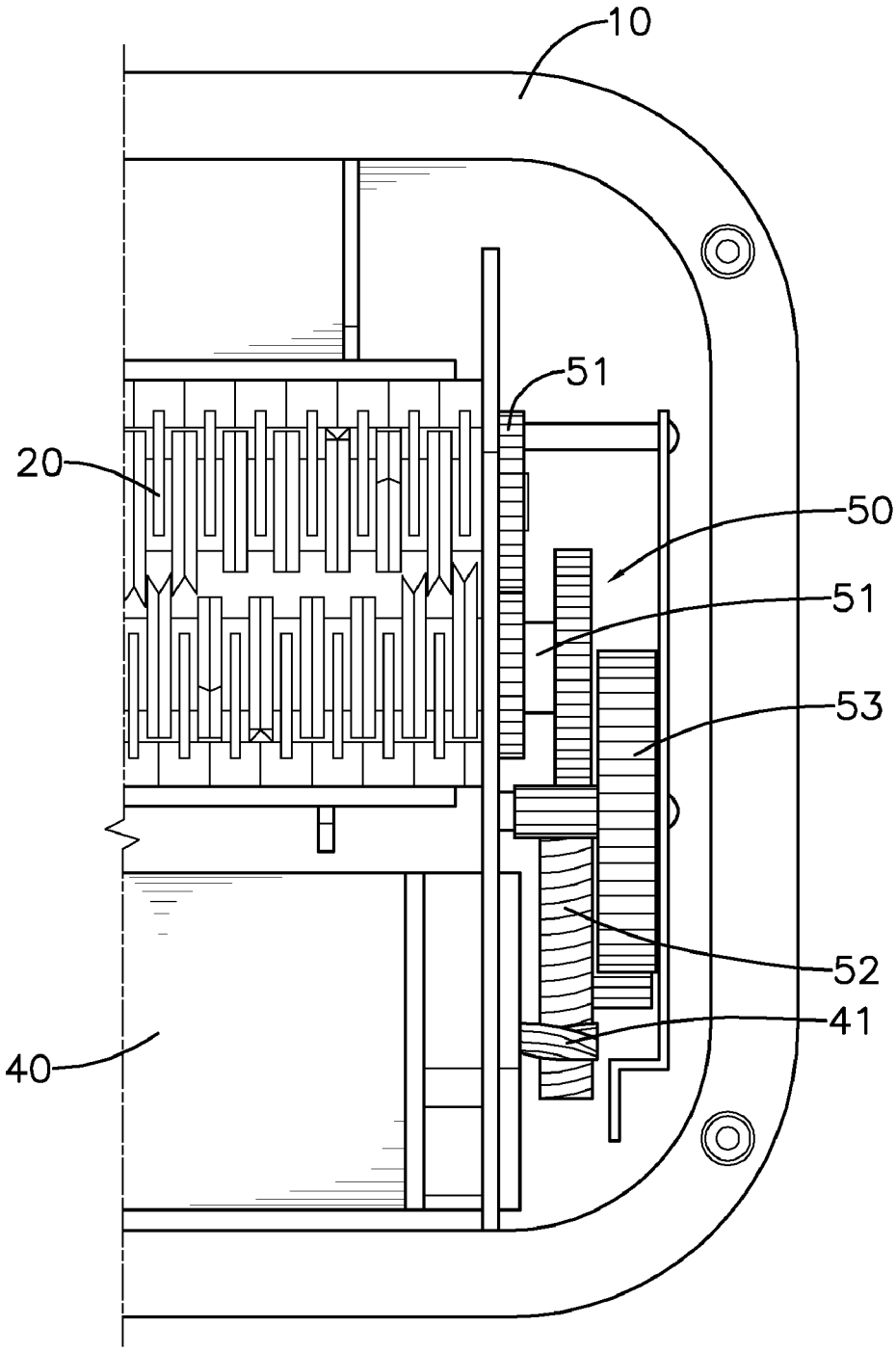
FIG. 5 is an enlarged top view of the single-motor shredder in FIG. 1.
Figure 7:
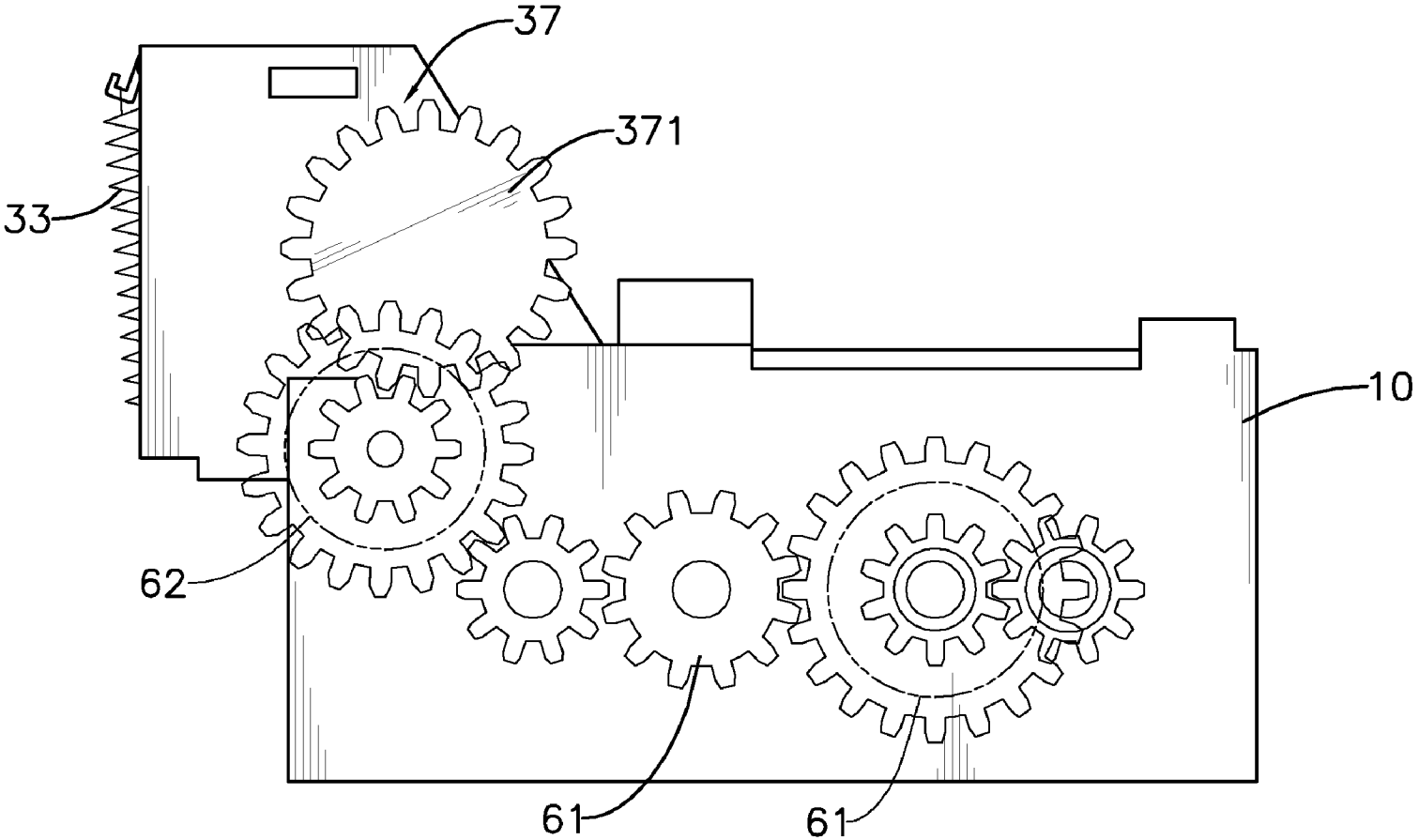
FIG. 7 is a side view of the single-motor shredder in FIG. 1.

With reference to FIGS. 1, 5 and 7, a single-motor shredder in accordance with the present invention is mounted on a receptacle and comprises a housing (10), multiple cutting rollers (20), a paper feeding mechanism (30), a motor (40), a first gear set (50) and a second gear set (60).

The housing (10) has an entrance (11), an exit and a slide (12). The entrance (11) is formed through a top adjacent to a rear of the housing (10). The exit is formed through a bottom adjacent to a front of the housing (10) and corresponds to and communicates with the receptacle. The slide (12) is mounted obliquely on the top and corresponds to the entrance (11) of the housing (10).

With further reference to FIG. 5, the cutting rollers (20) are parallelly mounted rotatably in the housing (10) and correspond to the exit of the housing (10). Each cutting roller (20) has an input end and an output end.

Figure 2:
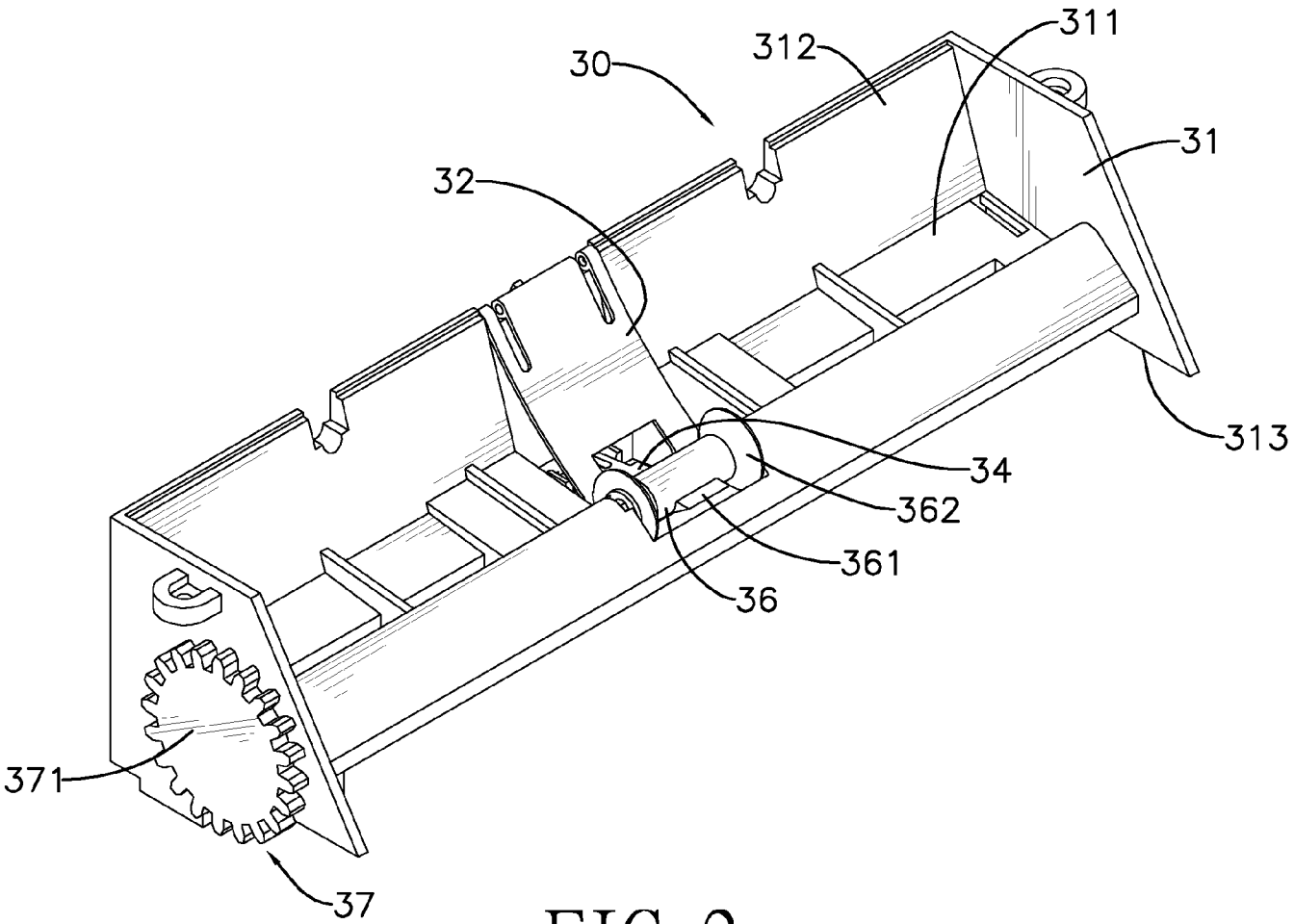
FIG. 2 is a perspective view of a paper feeding mechanism of the single-motor shredder in FIG. 1.
Figure 3:
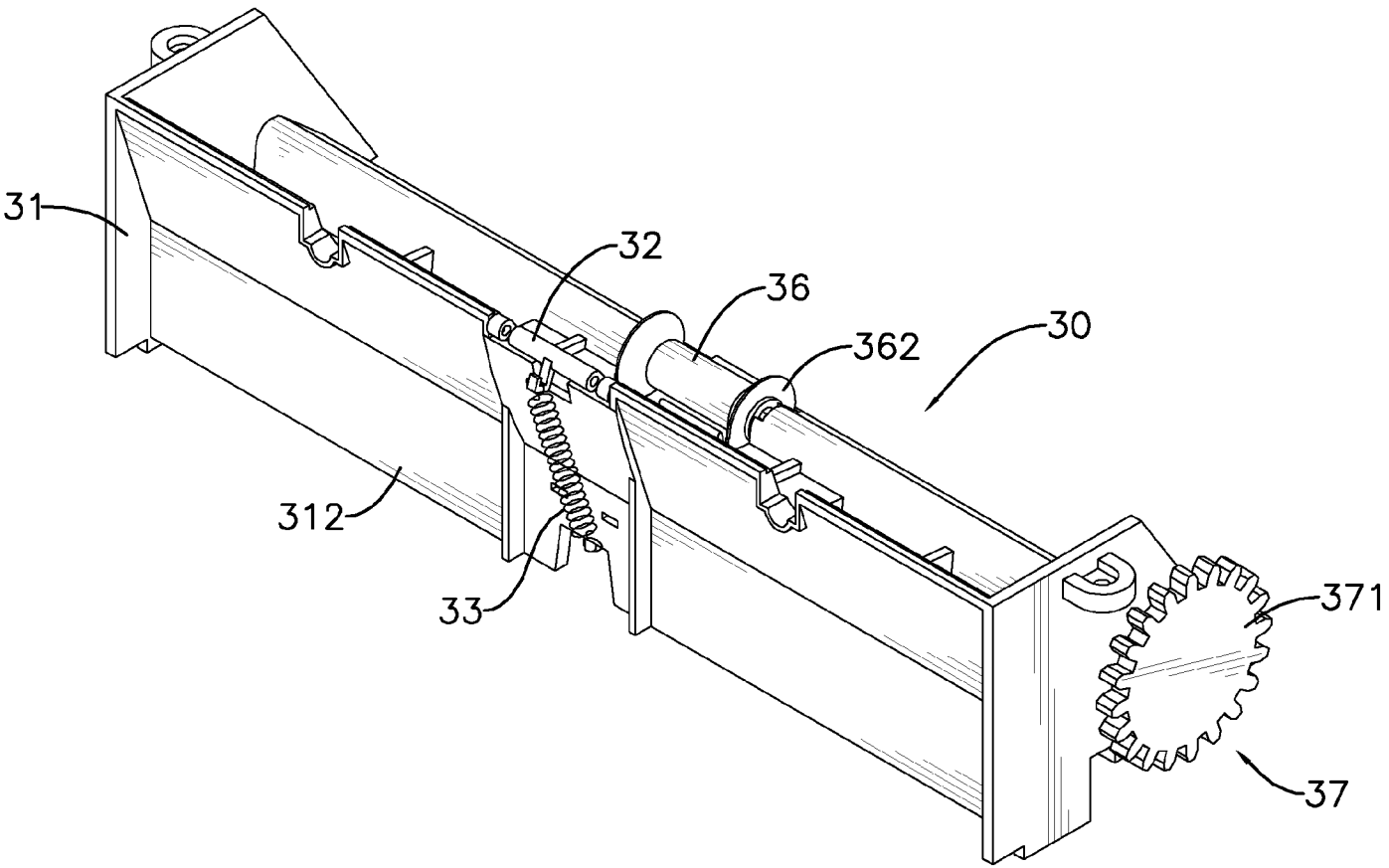
FIG. 3 is another perspective view of the paper feeding mechanism of the single-motor shredder in FIG. 1.
Figure 4:
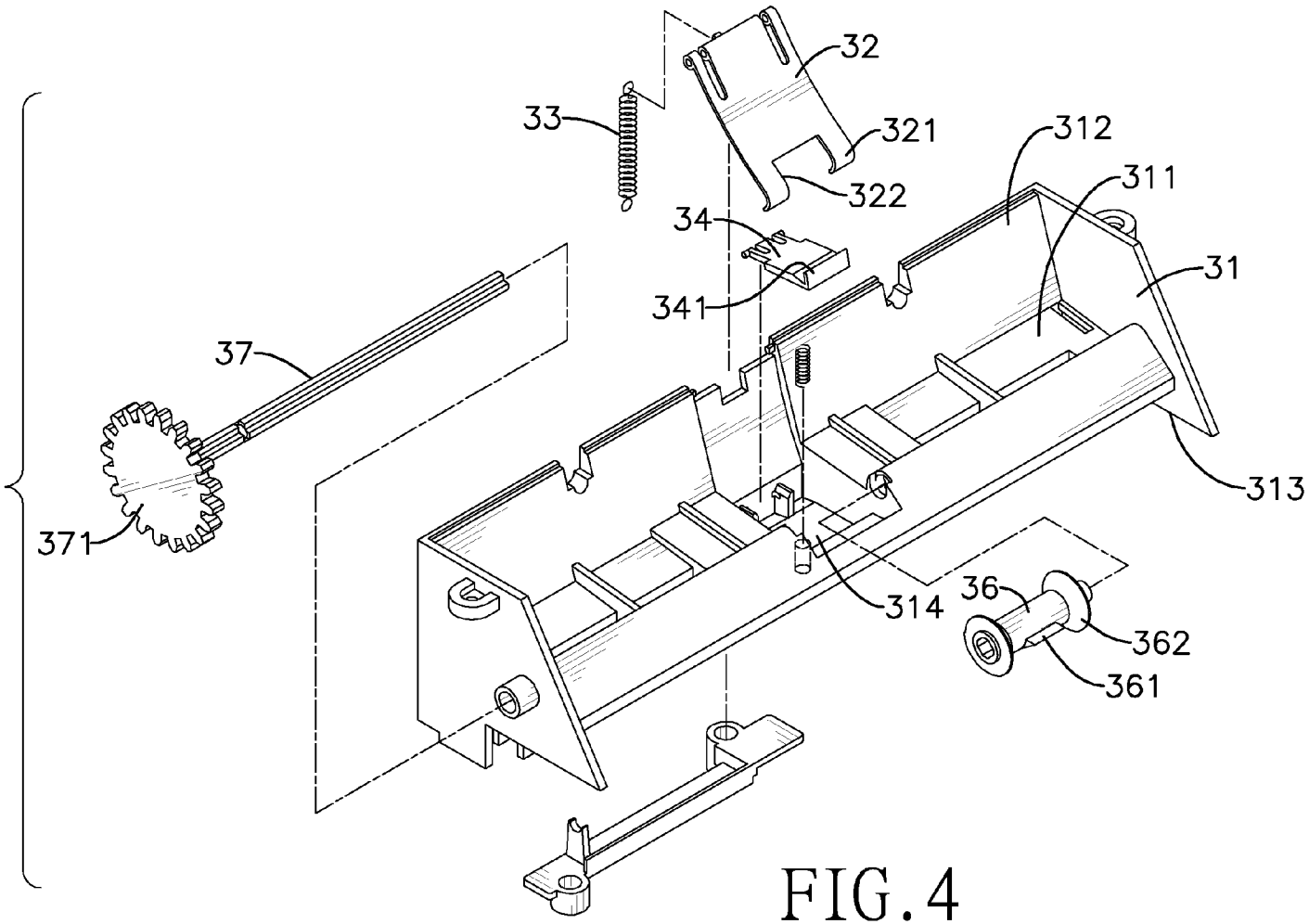
FIG. 4 is an exploded perspective view of the paper feeding mechanism of the single-motor shredder in FIG. 1.

With further reference to FIGS. 2 to 4, the paper feeding mechanism (30) is mounted in the housing (10), corresponds to the entrance (11) of the housing (10) and has a mounting bracket (31), a pushing panel (32), a first resilient element (33), an arranging panel (34), a second resilient element (35), a split rod (36), a transmission rod (37) and multiple sensors (38).

The mounting bracket (31) is securely mounted in the housing (10), corresponds to the entrance (11) of the housing (10) and has a supporting panel (311), a rear panel (312), a feeding hole (313) and a mounting recess (314). The rear panel (312) is attached to a rear edge of the supporting panel (311). The feeding hole (313) is elongated and is formed through the supporting panel (311). The mounting recess (314) is formed in an upper surface of the supporting panel (311) and between the rear panel (312) and the feeding hole (313).

The pushing panel (32) is obliquely disposed between the supporting panel (311) and the rear panel (312) of the mounting bracket (31) and has an upper edge, a lower edge, two arms (321) and an indentation (322). The upper edge of the pushing panel (32) is rotatably connected to an upper edge of the rear panel (312). The lower edge of the pushing panel (32) corresponds to the supporting panel (311). The arms (321) separately protrude from the lower edge of the pushing panel (32). The through recess (322) is defined between the arms (321). The first resilient element (33) is disposed on a rear surface of the rear panel (312) and has two ends respectively connected to the rear panel (312) and the upper edge of the pushing panel (32). Thus, the lower edge of the pushing panel (32) tends to pivot upwardly.

The arranging panel (34) is mounted on the supporting panel (311) and through the indentation (322) of the pushing panel (32), may be mounted in the mounting recess (314) of the supporting panel (311) and has a pivot edge, a distal edge and a hook (341). The pivot edge of the arranging panel (34) is rotatably connected to the supporting panel (311). The hook (341) is formed on the outer edge of the arranging panel (34). The second resilient element (35) is mounted on the supporting panel (311), may be mounted in the mounting recess (314) of the supporting panel (311) and is disposed between the supporting panel (311) and the arranging panel (34).

Figure 9:
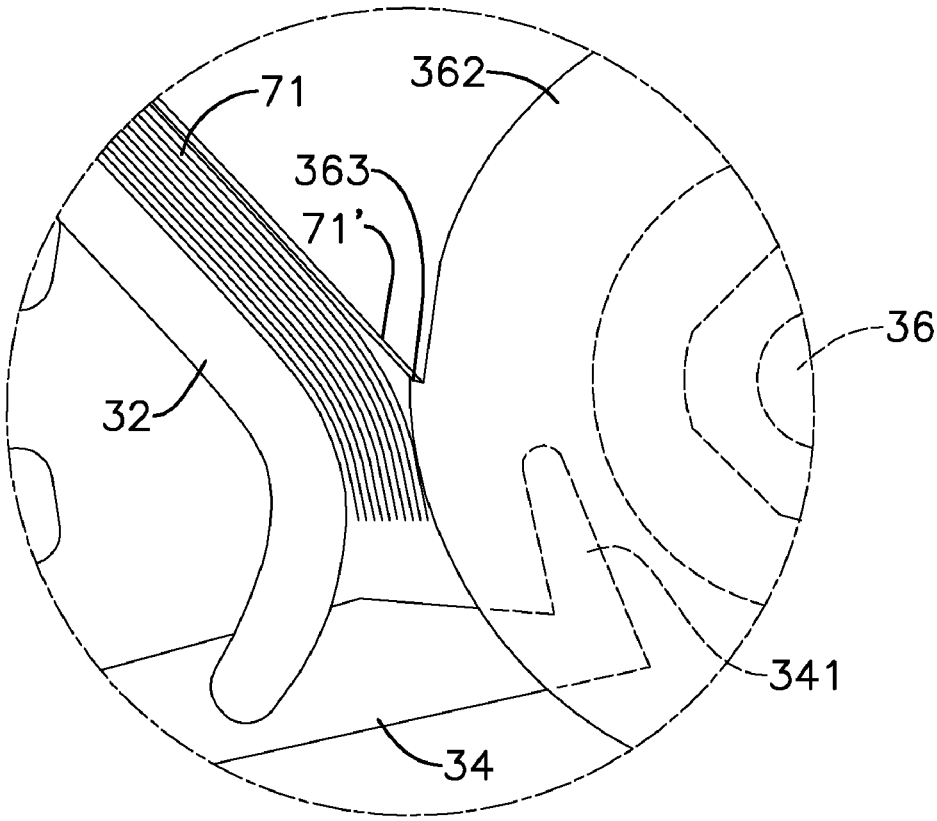
FIG. 9 is an enlarged operational side view of the single-motor shredder in FIG. 1.

With further reference to FIG. 9, the split rod (36) is rotatably mounted on the supporting panel (311) adjacent to the lower edge of the pushing panel (32) and the distal edge of the arranging panel (34), may be mounted in the mounting recess (314) of the supporting panel (311) and has a pushing protrusion (361) and two feeding wheels (362). The pushing protrusion (361) is formed on an outer surface of the split rod (36) and selectively pushes the arranging panel (34). The feeding wheels (362) are respectively formed on two opposite ends of the split rod (36), abut the pushing panel (32) and may respectively abut the arms (321) of the pushing panel (32) to limit a pivot angle of the pushing panel (32). Each feeding wheel (362) has a notch (363). The notch (363) is formed in a peripheral edge of the feeding wheel (362), is offset to the pushing protrusion (361) and may be offset to the pushing protrusion (361) by 180 degrees.

The transmission rod (37) is rotatably mounted through the supporting panel (311), is securely attached to the split rod (36) so the split rod (36) rotates simultaneously with the transmission rod (37) and has an outer end and a transmission wheel (371). The outer end of the transmission rod (37) protrudes out of the mounting bracket (31) and corresponds to the output ends of the cutting rollers (20). The transmission wheel (371) is attached to the outer end of the transmission rod (37).

The sensors (38) are mounted on the mounting bracket (31) and correspond to each other.

The motor (40) is mounted in the housing (10), is electrically connected to the sensors (38) and has a driving shaft (41). The driving shaft (41) protrudes rotatably from the motor (40) and may be a helical gear.

The first gear set (50) is mounted in the housing (10) and between the driving shaft (41) of the motor (40) and the input ends of the cutting rollers (20), connects the driving shaft (41) of motor (40) with the cutting rollers (20) and may have multiple first roller gears (51), an input gear (52) and multiple reduction gears (53). The first roller gears (51) are respectively mounted securely on the input ends of the cutting rollers (20) and engage each other. The input gear (52) is rotatably mounted in the housing (10) and engages the driving shaft (41) of the motor (40). The reduction gears (53) are rotatably mounted in the housing (10), engage each other and connect the input gear (52) with one of the first roller gears (51).

Figure 6:
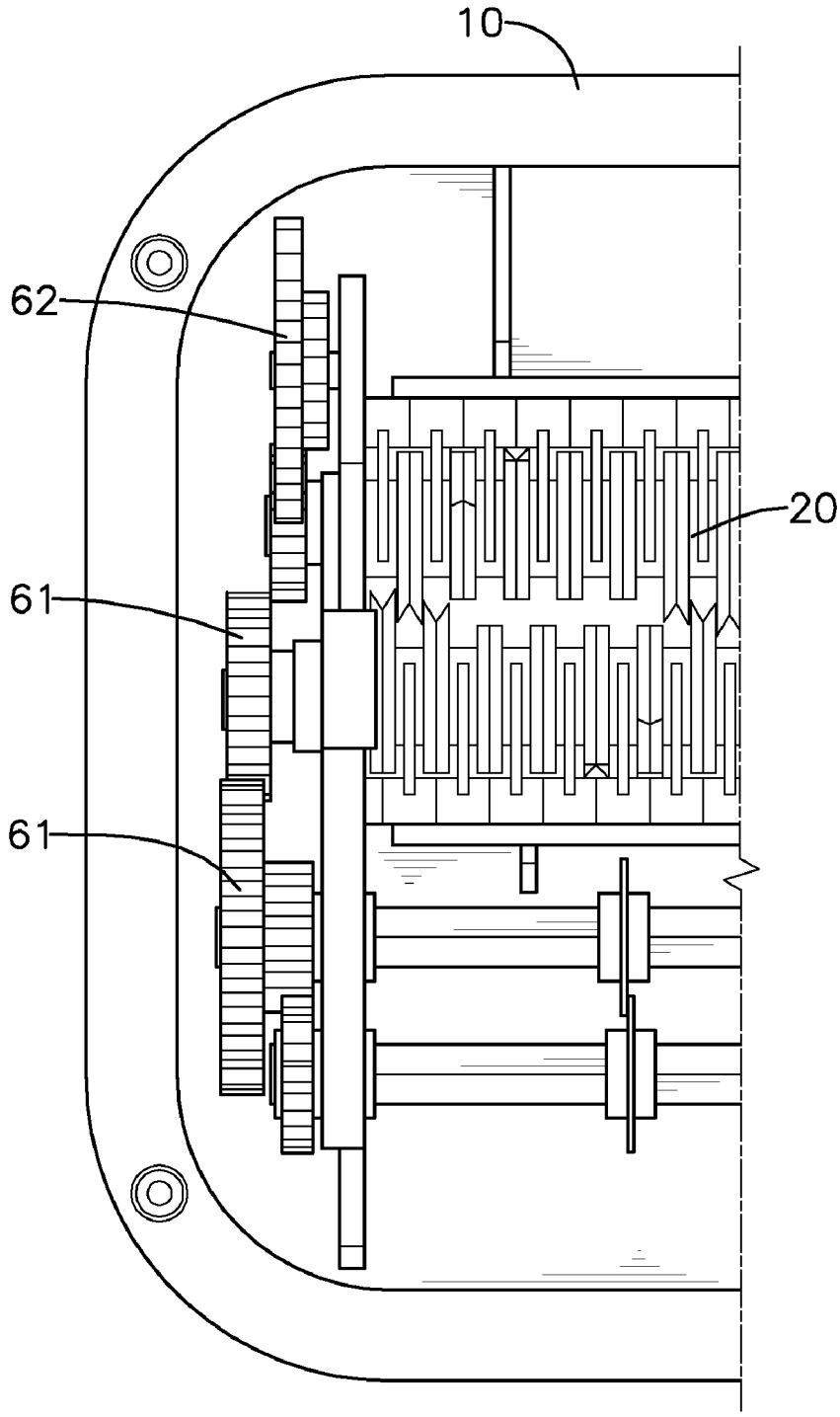
FIG. 6 is another enlarged top view of the single-motor shredder in FIG. 1.

With further reference to FIGS. 6 and 7, the second gear set (60) is mounted in the housing (10) and between the transmission rod (37) and the output ends of the cutting rollers (20), connects the transmission rod (37) with the cutting rollers (20) and may have multiple second roller gears (61) and an output gear (62). The second roller gears (62) are respectively mounted securely on the output ends of the cutting rollers (20) and engage each other. The output gear (62) is rotatably mounted in the housing (10) and engages one of the second roller gears (62) and the transmission wheel (371) of the transmission rod (37).

Figure 8:
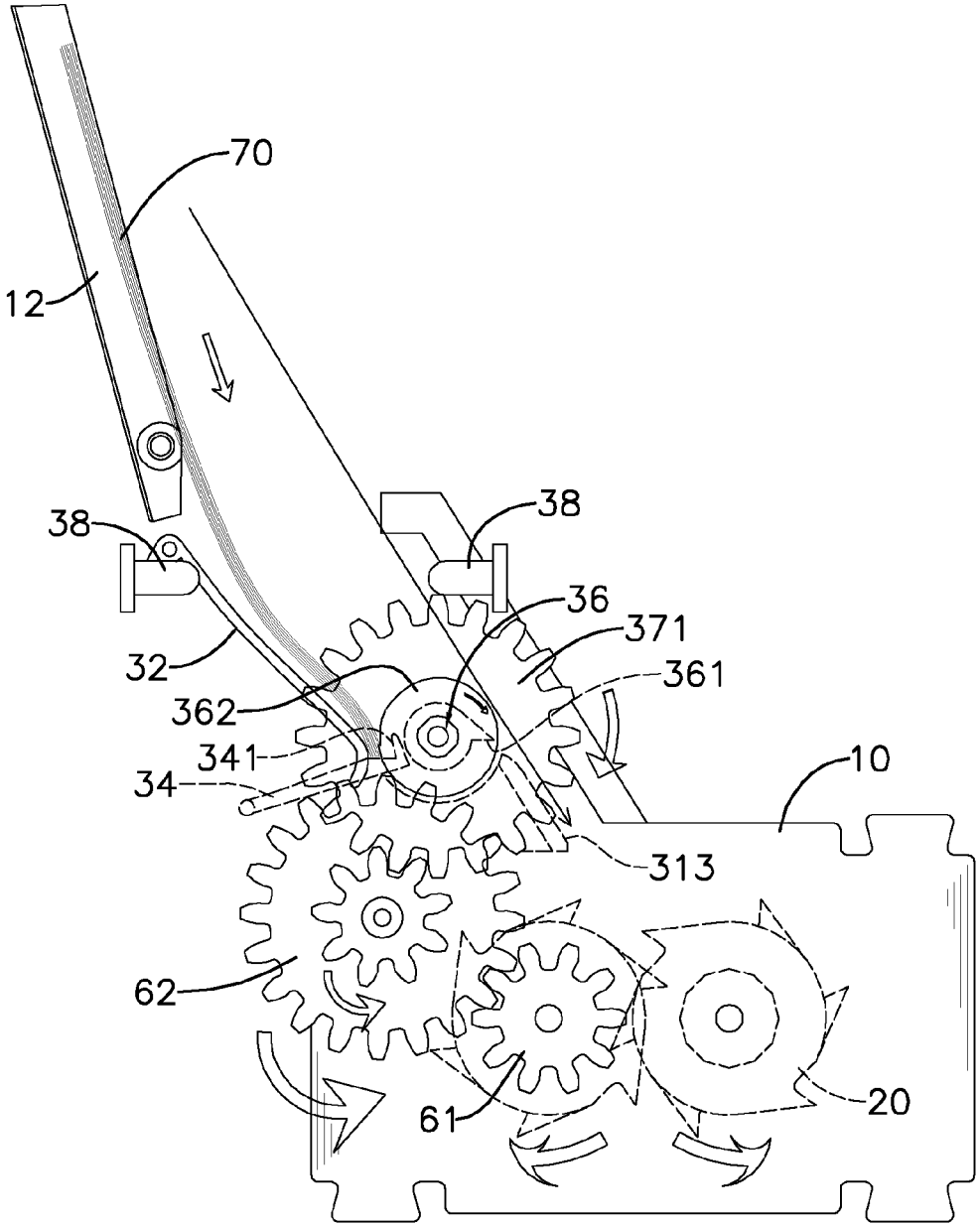
FIG. 8 is an operational side view of the single-motor shredder in FIG. 1.

With further reference to FIG. 8, when the sensors (38) detect that a stack of paper (70) has been put into the paper feeding mechanism (30), the sensors (38) switch on the motor (40). When no paper (70) is in the paper feeding mechanism (30), the sensors (40) switch off the motor (40). Therefore, as the stack of paper (70) is put on the slide (12) of the housing (10) and slides through the entrance (11) of the housing (10) and into the paper feeding mechanism (30), the hook (341) of the arranging panel (34) holds the stack of paper (70) and the motor (40) is switched on. Activation of the motor (40) rotates the cutting rollers (20) through the first gear set (50) and the transmission wheel (371) of the transmission rod (37) and the split rod (36) by the second gear set (60).

With further reference to FIG. 9, with rotation of the split rod (36), the notches (363) of the feeding wheels (362) lift a small pile of paper (70'). Then the pile of paper (70') is move along the peripheral edges of the feeding wheels (362), slides through the feeding hole (313) of the mounting bracket (31) and then into the cutting rollers (20).

Figure 10:
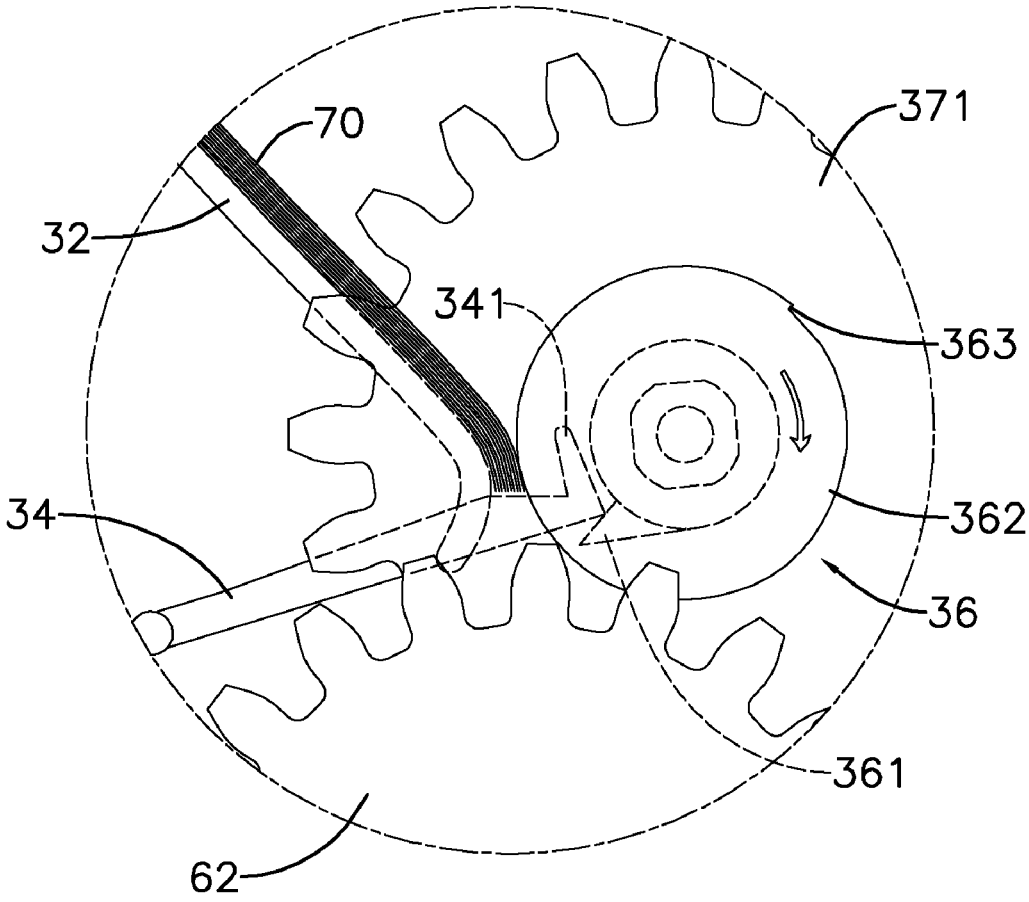
FIG. 10 is another enlarged operational side view of the single-motor shredder in FIG. 1.

With further reference to FIG. 10, the pushing protrusion (361) of the split rod (36) abuts the arranging panel (34) so the arranging panel (34) holds the stack of paper (70) up. The split rod (36) does not feed any paper (70) into cutting rollers (20) and the stack of paper (70) is rearranged by the arranging panel (34).

The single-motor shredder as described has the following advantages. Only one motor (40) is needed to drive the cutting rollers (20) and the paper feeding mechanism (30). Therefore, the shredder is light and a manufacturing cost of the shredder is lowered. Moreover, the feeding wheels (362) with notches (363) separate the stack of paper (70) into small piles and the pushing protrusion (361) of the split rod (36) and the arranging panel (34) allows the stack of paper (70) to be shredded one pile after another. Thus, the paper (70) does not jam the cutting rollers (20) so improving lifetime of the shredder.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A single-motor shredder comprising a housing;

multiple cutting rollers parallelly mounted rotatably in the housing, and each cutting roller having an input end and an output end;

a paper feeding mechanism mounted in the housing and having a mounting bracket securely mounted in the housing and having a supporting panel; and a rear panel attached to a rear edge of the supporting panel;

a pushing panel obliquely disposed between the supporting panel and the rear panel of the mounting bracket and having an upper edge rotatably connected to an upper edge of the rear panel; and a lower edge corresponding to the supporting panel;

a first resilient element disposed on a rear surface of the rear panel and having two ends respectively connected to the rear panel and the upper edge of the pushing panel;

a split rod rotatably mounted on the supporting panel adjacent to the lower edge of the pushing panel and the distal edge of the arranging panel and having two feeding wheels respectively formed on two opposite ends of the split rod and abutting the pushing panel, and each feeding wheel having a notch formed in a peripheral edge of the feeding wheel; and a transmission rod rotatably mounted through the supporting panel and securely attached to the split rod;

a motor mounted in the housing and having a driving shaft protruding rotatably from the motor;

a first gear set mounted in the housing and between the driving shaft of the motor and the input ends of the cutting rollers and connecting the driving shaft of motor with the cutting rollers; and a second gear set mounted in the housing and between the transmission rod and the output ends of the cutting rollers and connecting the transmission rod with the cutting rollers.

2. The single-motor shredder as claimed in claim 1, wherein the pushing panel further has two arms separately protruding from the lower edge of the pushing panel; and an indentation defined between the arms;

the paper feeding mechanism further has an arranging panel mounted on the supporting panel and through the indentation of the pushing panel and having a pivot edge rotatably connected to the supporting panel;

a distal edge; and a hook formed on the outer edge of the arranging panel;

a second resilient element mounted on the supporting panel and disposed between the supporting panel and the arranging panel;

the split rod further has a pushing protrusion formed on an outer surface of the split rod and selectively pushing the arranging panel;

the feeding wheels of the split rod respectively abut the arms of the pushing panel; and the notch of each feeding wheel is offset to the pushing protrusion.

3. The single-motor shredder as claimed in claim 1, wherein the transmission rod further has an outer end protruding out of the mounting bracket and corresponding to the output ends of the cutting rollers; and a transmission wheel attached to the outer end of the transmission rod;

the first gear set further has multiple first roller gears respectively mounted securely on the input ends of the cutting rollers and engaging each other;

an input gear rotatably mounted in the housing and engaging the driving shaft of the motor; and multiple reduction gears rotatably mounted in the housing, engaging each other and connecting the input gear with one of the first roller gears; and the second gear set further has multiple second roller gears respectively mounted securely on the output ends of the cutting rollers and engaging each other; and an output gear rotatably mounted in the housing and engaging one of the second roller gears and the transmission wheel of the transmission rod.

4. The single-motor shredder as claimed in claim 2, wherein the transmission rod further has an outer end protruding out of the mounting bracket and corresponding to the output ends of the cutting rollers; and a transmission wheel attached to the outer end of the transmission rod;

the first gear set further has multiple first roller gears respectively mounted securely on the input ends of the cutting rollers and engaging each other;

an input gear rotatably mounted in the housing and engaging the driving shaft of the motor; and multiple reduction gears rotatably mounted in the housing, engaging each other and connecting the input gear with one of the first roller gears; and the second gear set further has multiple second roller gears respectively mounted securely on the output ends of the cutting rollers and engaging each other; and an output gear rotatably mounted in the housing and engaging one of the second roller gears and the transmission wheel of the transmission rod.

5. The single-motor shredder as claimed in claim 2, wherein the mounting bracket further has a feeding hole being elongated and formed through the supporting panel; and a mounting recess formed in an upper surface of the supporting panel and between the rear panel and the feeding hole; and the arranging panel, the second resilient element and the split rod are mounted in the mounting recess of the supporting panel.

6. The single-motor shredder as claimed in claim 4, wherein the mounting bracket further has a feeding hole being elongated and formed through the supporting panel; and a mounting recess formed in an upper surface of the supporting panel and between the rear panel and the feeding hole; and the arranging panel, the second resilient element and the split rod are mounted in the mounting recess of the supporting panel.

7. The single-motor shredder as claimed in claim 5, wherein the housing further has an entrance formed through a top adjacent to a rear of the housing;

an exit formed through a bottom adjacent to a front of the housing; and a slide mounted obliquely on the top and corresponding to the entrance of the housing;

the cutting rollers correspond to the exit of the housing;

the paper feeding mechanism corresponds to the entrance of the housing and further has multiple sensors mounted on the mounting bracket, corresponding to each other and electrically connected to the motor; and the mounting bracket corresponds to the entrance of the housing.

8. The single-motor shredder as claimed in claim 6, wherein the housing further has an entrance formed through a top adjacent to a rear of the housing;

an exit formed through a bottom adjacent to a front of the housing; and a slide mounted obliquely on the top and corresponding to the entrance of the housing;

the cutting rollers correspond to the exit of the housing;

the paper feeding mechanism corresponds to the entrance of the housing and further has multiple sensors mounted on the mounting bracket, corresponding to each other and electrically connected to the motor; and the mounting bracket corresponds to the entrance of the housing.

9. The single-motor shredder as claimed in claim 7, wherein the notch of each feeding wheel of the split rod is offset to the pushing protrusion of the split rod by 180 degrees.

10. The single-motor shredder as claimed in claim 8, wherein the notch of each feeding wheel of the split rod is offset to the pushing protrusion of the split rod by 180 degrees.

* * * * *